US005765298A

United States Patent [19]

Potter et al.

[11] Patent Number: 5,765,298

[45] Date of Patent: Jun. 16, 1998

[54] ATHLETIC SHOE WITH PRESSURIZED ANKLE COLLAR

[75] Inventors: Daniel R. Potter, Beaverton; Bruce J. Kilgore, Lake Oswego, both of Oreg.

[73] Assignee: Nike, Inc., Beaverton, Oreg.

[21] Appl. No.: 32,405

[22] Filed: Mar. 12, 1993

Related U.S. Application Data

[63] Continuation of Ser. No. 879,725, May 6, 1992, abandoned, which is a continuation of Ser. No. 702,129, May 16, 1991, abandoned, which is a continuation of Ser. No. 480,586, Feb. 15, 1990, abandoned, which is a continuation-in-part of Ser. No. 416,262, Oct. 3, 1989, abandoned, which is a continuation-in-part of Ser. No. 324,705, Mar. 17, 1989, abandoned.

[51] Int. Cl.[6] ..... A43B 7/20

[52] U.S. Cl. ..... 36/89; 36/93; 36/114

[58] Field of Search ..... 36/71, 29, 89, 36/88, 93, 92, 114, 119, 91; 128/80 H

[56] References Cited

U.S. PATENT DOCUMENTS

| | | | |
|---|---|---|---|
| 435,452 | 9/1890 | Richards . | |
| 518,579 | 4/1894 | Annenberg | 36/2.6 |
| 746,338 | 12/1903 | Keen | 54/82 |
| 1,313,924 | 8/1919 | Stewart | 128/594 |
| 1,364,226 | 1/1921 | Wherry . | |
| 1,375,585 | 4/1921 | Goodwin | 36/71 |
| 1,605,985 | 11/1926 | Rasmussen . | |
| 1,730,466 | 10/1929 | Mallott . | |
| 1,757,019 | 5/1930 | Mott . | |
| 1,954,122 | 4/1934 | Fiori | 36/71 |
| 2,020,240 | 11/1935 | Cochran . | |
| 2,028,060 | 1/1936 | Gilbert . | |
| 2,086,389 | 7/1937 | Pearson | 36/71 |

(List continued on next page.)

FOREIGN PATENT DOCUMENTS

| | | |
|---|---|---|
| 515639 | 12/1952 | Belgium . |
| 951117 | 7/1974 | Canada . |
| 951118 | 7/1974 | Canada . |
| 40189 | 11/1981 | European Pat. Off. . |
| 0 094 868 | 11/1983 | European Pat. Off. . |
| 152401 | 8/1985 | European Pat. Off. . |
| 155495 | 9/1985 | European Pat. Off. . |
| 221808 | 5/1987 | European Pat. Off. . |
| 1406610 | 6/1965 | France . |
| 1406610 | 11/1965 | France . |

(List continued on next page.)

OTHER PUBLICATIONS

"Pumping Up", Photo and discussion, Footwear News, Apr. 3, 1989, p. 1.

"New Generation", Photos and discussion, Footwear News, Sep. 11, 1989, p. 26.

"Primed To Deliver The Pump", Footwear News, Oct. 2, 1989.

"NIKE Takes To The Scale To Win The Weight Test", Footwear News, Jan. 22, 1990.

"Reebok Readies High-Tech Double Pump", Footwear News, Nov. 4, 1991, p. 26.

"Reebok Get Suspension Placed On Spalding Gloves", Footwear News, Jul. 22, 1991, p. 68.

"Reebok Actively Seeking To License Technology," Footwear News, Jul. 22 1991, p. 66.

L.A. Gear REGULATOR Ad, Footwear News, Sep. 24, 1990.

(List continued on next page.)

*Primary Examiner*—Ted Kavanaugh

*Attorney, Agent, or Firm*—Banner & Witcoff, Ltd.

[57] ABSTRACT

An athletic shoe formed of a sole, an upper attached to the sole and including an ankle portion extending around the medial and lateral malleoli, and an inflatable bladder attached within the ankle portion. The inflatable bladder has a medial section and a lateral section, with an inlet mechanism for supplying pressurized gas to the interior of the bladder. Weld lines divide the medial and lateral sections into upper and lower portions and prevent the formation of restrictive vertical columns of pressurized gas in the medial and lateral sections.

49 Claims, 6 Drawing Sheets

U.S. PATENT DOCUMENTS

| | | | |
|---|---|---|---|
| 2,103,108 | 12/1937 | Broecker et al. | 152/12 |
| 2,141,033 | 12/1938 | Crowley | 284/19 |
| 2,150,290 | 3/1939 | Mulvey . | |
| 2,177,116 | 10/1939 | Persichino . | |
| 2,247,961 | 7/1941 | Mulvey . | |
| 2,255,932 | 9/1941 | Kraft et al. | 152/430 |
| 2,276,502 | 3/1942 | McCoy | 277/42 |
| 2,365,807 | 12/1944 | Dialynas | 36/8.5 |
| 2,439,545 | 4/1948 | Matlas . | |
| 2,531,763 | 11/1950 | Andre | 36/2.5 |
| 2,600,239 | 6/1952 | Gilbert | 36/153 |
| 2,605,560 | 8/1952 | Gouabault . | |
| 2,638,690 | 5/1953 | Bullard | 36/71 |
| 2,663,020 | 12/1953 | Cushman . | |
| 2,686,006 | 8/1954 | Hasselquist . | |
| 2,715,231 | 8/1955 | Marston | 9/17 |
| 2,774,152 | 12/1956 | Alber | 36/71 |
| 2,830,585 | 4/1958 | Weiss | 128/166 |
| 2,942,359 | 6/1960 | Bushway et al. | 36/8.5 |
| 3,027,659 | 4/1962 | Gianola . | |
| 3,030,640 | 4/1962 | Gosman | 5/349 |
| 3,078,684 | 2/1963 | Schmid et al. | 137/223 |
| 3,081,774 | 3/1963 | Lelyveld . | |
| 3,121,430 | 2/1964 | O'Reilly | 128/595 |
| 3,134,418 | 5/1964 | McConkie | 152/427 |
| 3,186,004 | 6/1965 | Carlini . | |
| 3,273,263 | 9/1966 | Klima . | |
| 3,312,213 | 4/1967 | Timm . | |
| 3,316,663 | 5/1967 | Neu . | |
| 3,372,495 | 3/1968 | Finn | 36/2.5 |
| 3,410,004 | 11/1968 | Finn . | |
| 3,469,576 | 9/1969 | Smith et al. | 128/595 |
| 3,508,572 | 4/1970 | Paffrath | 137/231 |
| 3,537,716 | 11/1970 | Norgiel . | |
| 3,659,361 | 5/1972 | White, Sr. . | |
| 3,664,043 | 5/1972 | Polumbus, Jr. | 36/71 |
| 3,685,176 | 8/1972 | Rudy | 36/71 |
| 3,716,930 | 2/1973 | Brahm . | |
| 3,744,159 | 7/1973 | Nishimura | 36/2.5 |
| 3,750,310 | 8/1973 | Messner et al. . | |
| 3,758,964 | 9/1973 | Nishimura | 36/205 |
| 3,760,056 | 9/1973 | Rudy | 264/299 |
| 3,765,422 | 10/1973 | Smith | 36/153 |
| 3,854,228 | 12/1974 | Conroy | 36/71 |
| 3,872,511 | 3/1975 | Nichols . | |
| 3,876,746 | 4/1975 | Hanson . | |
| 3,925,916 | 12/1975 | Garbuio | 36/71 |
| 4,035,846 | 7/1977 | Jencks . | |
| 4,067,063 | 1/1978 | Ettinger . | |
| 4,068,323 | 1/1978 | Gwon . | |
| 4,123,855 | 11/1978 | Thedford | 36/3 B X |
| 4,126,323 | 11/1978 | Scherz . | |
| 4,178,013 | 12/1979 | Bataille . | |
| 4,183,155 | 1/1980 | Payne . | |
| 4,236,725 | 12/1980 | Bataille . | |
| 4,266,298 | 5/1981 | Graziano . | |
| 4,287,613 | 9/1981 | Schulz . | |
| 4,358,902 | 11/1982 | Cole et al. . | |
| 4,361,969 | 12/1982 | Vermonet | 36/88 |
| 4,370,754 | 2/1983 | Donzis . | |
| 4,385,456 | 5/1983 | Livernois et al. . | |
| 4,423,735 | 1/1984 | Comparetto . | |
| 4,446,634 | 5/1984 | Johnson et al. . | |
| 4,458,429 | 7/1984 | Schmid . | |
| 4,481,970 | 11/1984 | Reid | 137/223 |
| 4,538,367 | 9/1985 | Adams . | |
| 4,539,764 | 9/1985 | Prodier . | |
| 4,590,691 | 5/1986 | Oliviero . | |
| 4,593,690 | 6/1986 | Sheridan et al. . | |
| 4,631,843 | 12/1986 | Annovi . | |
| 4,662,087 | 5/1987 | Beuch | 36/119 X |
| 4,670,955 | 6/1987 | Huang . | |
| 4,702,022 | 10/1987 | Porcher . | |
| 4,712,316 | 12/1987 | Baggio . | |
| 4,719,670 | 1/1988 | Kurt . | |
| 4,724,627 | 2/1988 | Sisco | 36/119 |
| 4,730,403 | 3/1988 | Walkhoff . | |
| 4,730,610 | 3/1988 | Graebe . | |
| 4,739,813 | 4/1988 | Pagani | 152/427 |
| 4,744,157 | 5/1988 | Dubner | 36/88 |
| 4,756,306 | 7/1988 | Durlee . | |
| 4,763,426 | 8/1988 | Polus et al. . | |
| 4,776,110 | 10/1988 | Shiang | 36/3 B |
| 4,781,189 | 11/1988 | Vijil-Rosales . | |
| 4,819,685 | 4/1989 | Pagani | 137/223 |
| 4,832,482 | 5/1989 | Lakic . | |
| 4,836,235 | 6/1989 | Pagani | 137/223 |
| 4,852,564 | 8/1989 | Sheridan et al. . | |
| 4,912,861 | 4/1990 | Huang . | |
| 4,916,836 | 4/1990 | Baggio et al. . | |
| 4,921,147 | 5/1990 | Piorier . | |
| 4,927,191 | 5/1990 | Mikol . | |
| 4,936,029 | 6/1990 | Rudy | 36/71 X |
| 4,949,479 | 8/1990 | Ottieri | 36/117 |
| 4,955,149 | 9/1990 | Ottieri . | |
| 4,962,762 | 10/1990 | Beekil . | |
| 4,991,317 | 2/1991 | Lakic | 36/44 |
| 4,995,173 | 2/1991 | Spier . | |
| 4,999,932 | 3/1991 | Grim . | |
| 5,015,515 | 5/1991 | Paulin . | |

FOREIGN PATENT DOCUMENTS

| | | |
|---|---|---|
| 2144464 | 2/1973 | France . |
| 2252820 | 6/1976 | France . |
| 2356384 | 1/1978 | France . |
| 2407008 | 5/1979 | France . |
| 2496423 | 6/1982 | France . |
| 2308547 | of 0000 | Germany . |
| 2164921 | 10/1972 | Germany . |
| 2215098 | 5/1973 | Germany . |
| 2162619 | 6/1973 | Germany . |
| 2365329 | 9/1974 | Germany . |
| 2456612 | 6/1975 | Germany . |
| 3200139 | 5/1982 | Germany . |
| 3326085 | 7/1983 | Germany . |
| 3234086 | 3/1984 | Germany . |
| 3427644A | 1/1986 | Germany . |
| 3600437 | 7/1987 | Germany . |
| 11170 | 9/1887 | United Kingdom . |
| 23547 | 11/1889 | United Kingdom . |
| 26637 | 7/1897 | United Kingdom . |
| 866934 | 5/1961 | United Kingdom . |
| 939529 | 10/1963 | United Kingdom . |
| 2111821 | 7/1983 | United Kingdom . |
| WO 85/03623 | 8/1985 | WIPO . |
| 87/03789 | 7/1987 | WIPO . |
| 89/10074 | 11/1989 | WIPO . |
| 90/04323 | 3/1990 | WIPO . |
| 90/09115 | 8/1990 | WIPO . |
| WO 90/10396 | 9/1990 | WIPO . |

OTHER PUBLICATIONS

L.A. Gear REGULATOR Ad, Footwear News, Oct. 1, 1990.

"Has Sneaker Madness Gone Too Far?", Newsweek, Dec. 18, 1989.

"Now, Running On Empty", Newsweek, Dec. 3, 1990.

Robinson et al., Systematic Ankle Stabilization and the Effect on Performance, Medicine and Science In Sports and Exercise, vol. 18, No. 6, pp. 625–628, 1986.

"It's Back To The Future", Sportstyle, Mar. 6, 1989.

"Air Pressure From NIKE" Ad, USA Today, Oct. 24, 1989.

"Pumped–Up Reebok Runs Fast Break With New Shoe", Wall Street Journal, Dec. 20, 1989.

"From Air To Pump To Puma's Disc System, Sneaker Gimmicks Bound To New Heights", The Wall Street Journal, Oct. 31, 1991, p. B1.

ATHLETIC SHOE WITH PRESSURIZED ANKLE COLLAR

CROSS-REFERENCE TO RELATED APPLICATIONS

This application is a continuation of application Ser. No. 07/879,725, filed May 6, 1992 now abandoned which is a continuation of Ser. No. 07/702,129, filed May 16, 1991, now abandoned; which is a continuation of Ser. No. 07/480,586, filed Feb. 15, 1990, now abandoned; which is a CIP of Ser. No. 07/416,262, filed Oct. 3, 1989, now abandoned, which is a CIP of Ser. No. 07/324,705, filed Mar. 17, 1989, now abandoned. The contents of Ser. No. 07/324,705 and Ser. No. 07/416,262 are hereby incorporated by reference in their entireties.

TECHNICAL FIELD

The present invention relates to athletic shoes and, more particularly, to athletic shoes wherein the upper extends around the ankle bones, such as in high top basketball shoes. The invention is also directed to systems which customize the fit of the upper around the ankle bones by means of a pressurized collar.

BACKGROUND OF THE INVENTION

Current athletic shoes are a combination of many elements which have specific functions, all of which must work together for the support and protection of the foot during an athletic event. The shoes are designed to provide a unique and specific combination of traction, support, and protection to enhance athletic performance. Shoes are designed for specific sports and also to meet the specific characteristics of the user. For example, athletic shoes are designed differently for heavier persons than for lighter persons, differently for wide feet than for narrow feet, differently for high arches than for lower arches, and so forth. Some shoes are designed to correct physical problems, such as over-pronation, while others include devices, such an ankle supports, to prevent physical problems from developing.

An athletic shoe is divided into two general parts, an upper and a sole. The sole is attached to the bottom of the upper and provides traction, protection, and a durable wear surface. The upper is designed to snugly and comfortably enclose the foot. In a running or jogging shoe, the upper typically terminates below the ankle bones and will have several layers including a weather and wear resistant outer layer of leather or synthetic material, such as nylon, and a soft padded inner liner for foot comfort. In athletic shoes designed for sports which require the athlete to make sudden and rapid lateral movements, such as in basketball, football or tennis, the upper frequently extends up to or above the ankle bones (the medial and lateral malleoli). Such shoes are referred to as three-quarter height or high top shoes.

Attaining a proper fit around the ankle bones in three-quarter height and high top athletic shoes has been a problem because the uneven contour around the ankle bones varies from person to person. The typical prior art technique for fitting the upper around the ankle bones has been to line the ankle portion of the upper with a relatively soft foam material. However, since no two persons have precisely the same ankle bone configuration, the foam material only approximates a customized fit.

The use of adjustable air-inflated bladders in the ankle portion of an upper is also found in the prior art. The most frequent use of such bladders is found in ski boots wherein the upper is relatively inflexible and the air bladders are designed to embrace the ankle and lower leg and provide a restraining force against the foot. Such air bladders typically form rigid vertical columns along the medial and lateral sides of the foot and leg, thereby restricting movement of the foot. While such restriction of motion is desirable in a ski boot, it interferes with required foot motion in athletic shoes designed for athletic activities such as basketball, football and tennis. West German Patents 2,365,329 and 2,308,547 disclose examples of such air bladders used in a ski boot. As seen in FIGS. 4 and 5 of these patents, a separate tongue bladder and ankle bladder are provided, with the ankle bladder having cut out areas avoiding the malleoli and achilles tendon. However, as is typical in ankle bladders used in prior art ski boots, the ankle bladder forms relatively rigid vertical columns.

U.S. Pat. No. 3,758,964 relates particularly to ski boots and shows a bag member enclosed therein. Two chambers A and B are illustrated in FIG. 16 of the '964 patent. Chamber B forms an uninterrupted column of pressurized gas from the top to the bottom on both the medial and lateral sides; it also completely covers the malleoli. Chamber A, while not extending the entire vertical height, does form a restrictive column adjacent the malleoli. A different configuration for chambers A and B is depicted in FIG. 17 of the '964 patent. Chamber. B therein forms a less substantial vertical column, but one would still form along the outer perimeter, anterior of the malleoli. Chamber A also forms a vertical column posterior to the malleoli. FIG. 18 of this patent shows two small chambers B and a large chamber A. While chambers B cover the malleoli thereby restricting movement, chamber A forms vertical columns posterior to the malleoli. These vertical columns are formed near the malleoli and thereby have a stiffening effect which restricts plantar and dorsi flexion of the foot. Although these restrictive vertical columns in covering of the malleoli are preferred for activities such as skiing where the foot must be secured in the boot, they actually reduce the athlete's performance in sports such as basketball, football, soccer, tennis and running.

SUMMARY OF THE INVENTION

The present invention is directed to an athletic shoe comprised of a sole and an upper attached to the sole. The upper includes an ankle portion extending around at least a portion of the area of the medial and lateral malleoli. An inflatable bladder is attached within the ankle portion of the upper and has a medial section, a lateral section and an inlet mechanism for supplying pressurized gas to the interior of the bladder. A mechanism is incorporated into both the medial and lateral sections of the bladder for preventing the formation of restrictive vertical columns of pressurized gas in the medial and lateral sections.

In a preferred embodiment, the inflatable bladder is formed of two separate sheets or layers of elastomeric film connected to one another around the perimeter of the bladder. Polyurethane can be used, and it is also within the scope of the invention to make the bladder by blow molding. The medial and lateral sections of the bladder are both divided into upper and lower chambers by connection lines between the sheets of elastomeric film. The connection lines form the prevention mechanism and extend generally horizontally in each of the medial and lateral sections substantially along the entire horizontal extent of the lateral and medial sections in the area of the lateral and medial malleoli, respectively.

The medial and lateral sections of the inflatable bladder each have edges defining a cut out area. Each cut out area surrounds the area of a respective malleoli so that the medial and lateral malleoli are not covered by the inflatable bladder.

An athletic shoe incorporating the inflatable bladder of the present invention takes advantage of the adjustability of an inflatable bladder which can adapt itself to various ankle and leg configurations when pressurized, thereby providing a customized fit around any ankle. However, this advantage is obtained while alleviating the disadvantage of the rigidity found in prior art air bladders which formed relatively stiff vertical columns on either side of the ankle. Thus, the athletic shoe of the present invention can be comfortably worn in athletic activities such as basketball, football and tennis, which require a high degree of flexibility for plantar and dorsi flexion.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof and to the accompanying descriptive matter in which there is illustrated and described preferred embodiments of the invention.

DETAILED DESCRIPTION OF PREFERRED EMBODIMENTS OF THE INVENTION

Figure 1:
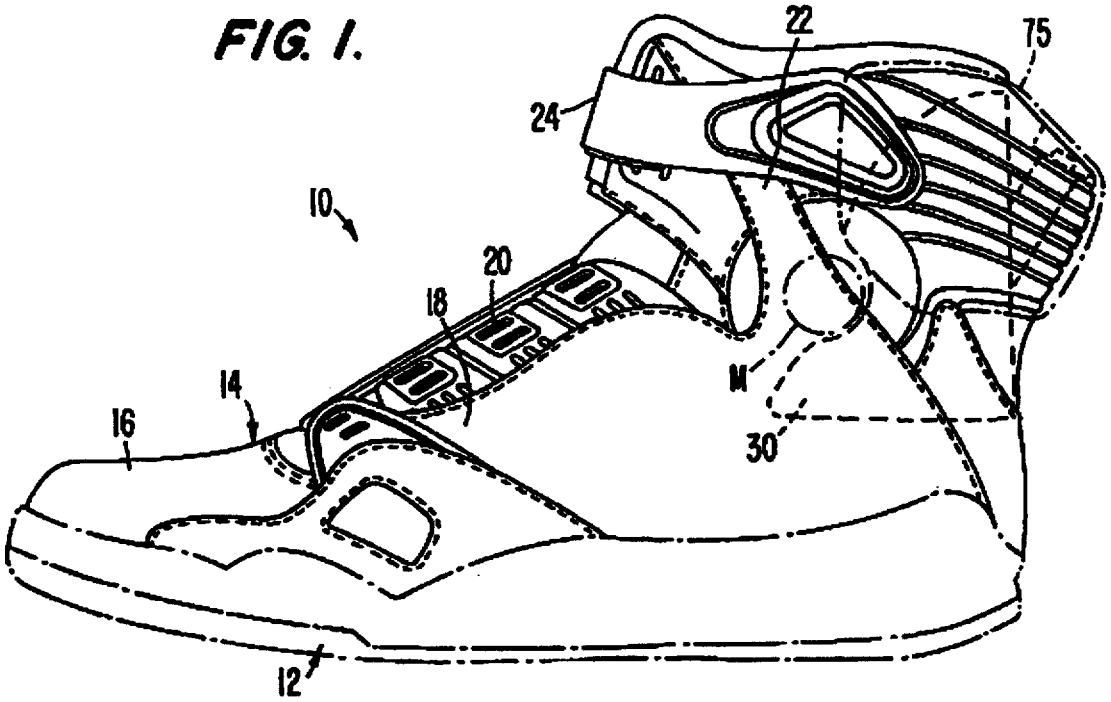
FIG. 1 is a lateral side view of an athletic shoe of the present invention illustrating the inflatable bladder thereof in dash line.
Figure 2:
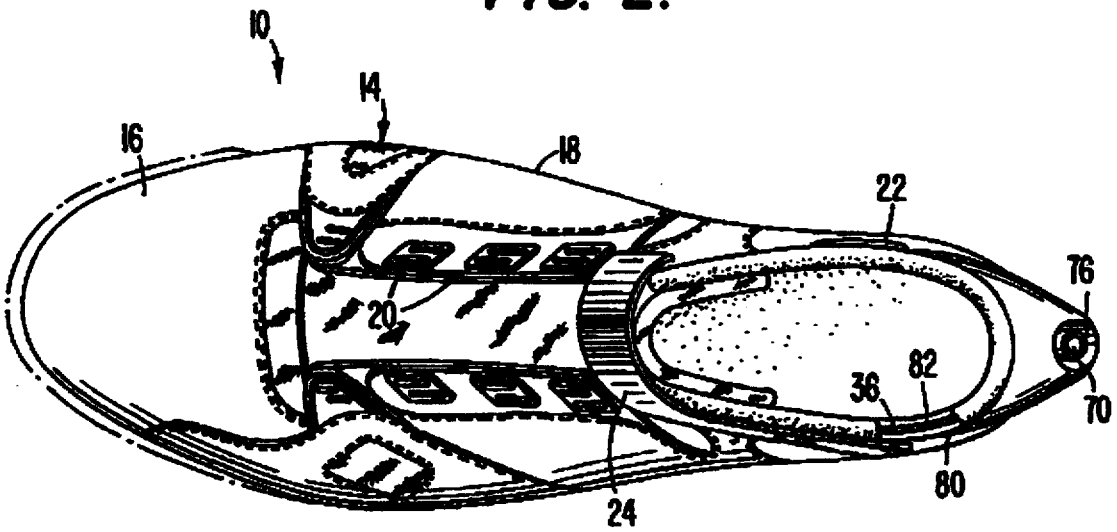
FIG. 2 is a top plan view of the athletic shoe, partially broken away, illustrating the inflatable bladder between an outer layer and inner liner of the upper.

Referring to the drawings, wherein like numerals indicate like elements, there is illustrated in FIGS. 1 and 2 an athletic shoe 10 in accordance with the present invention. Shoe 10 includes a sole 12 attached in a conventional manner, for example, by an adhesive, to an upper 14. Shoe 10 is preferably a high top type of athletic shoe wherein upper 14 extends around and above the medial and lateral malleoli, indicated as M in FIGS. 1 and 4. Sole 12 is a cup-type sole wherein a portion of the sole extends around the sides of upper 14. Upper 14 includes a toe portion 16, extending around the area of the toes, an instep portion 18 extending around the instep portion of the foot and including lacing eyelets 20 and an ankle portion 22 extending around the ankle and lower leg. Ankle portion 22 also includes lacing eyelets 20 and a tightening strap 24.

Figure 3:
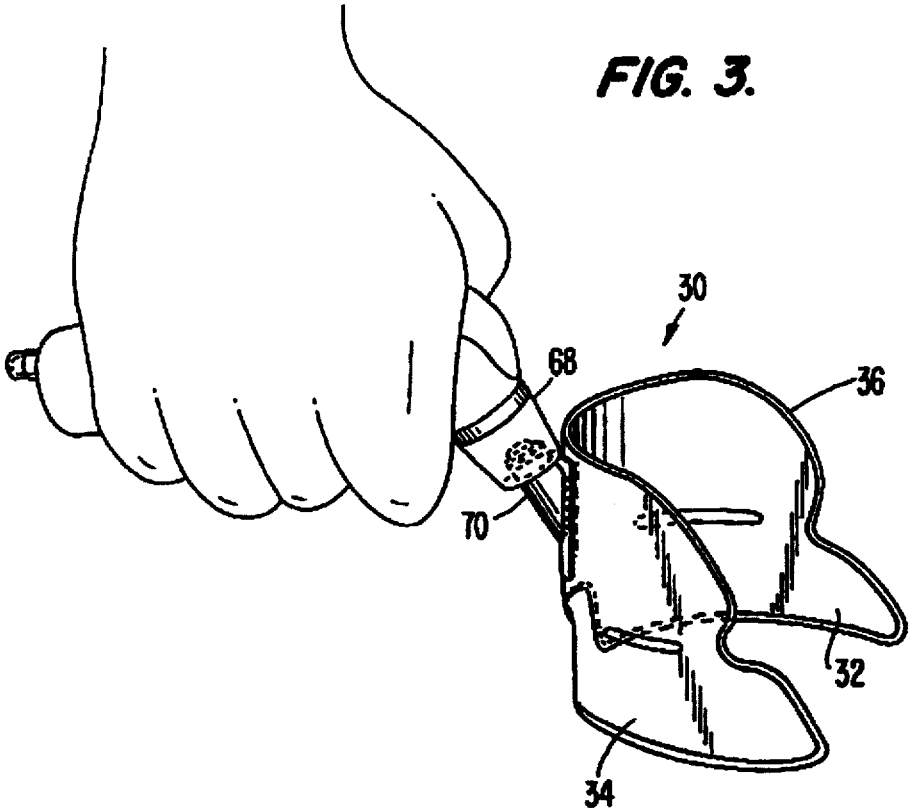
FIG. 3 is a perspective view of the inflatable bladder connected to a hand pump.
Figure 4:
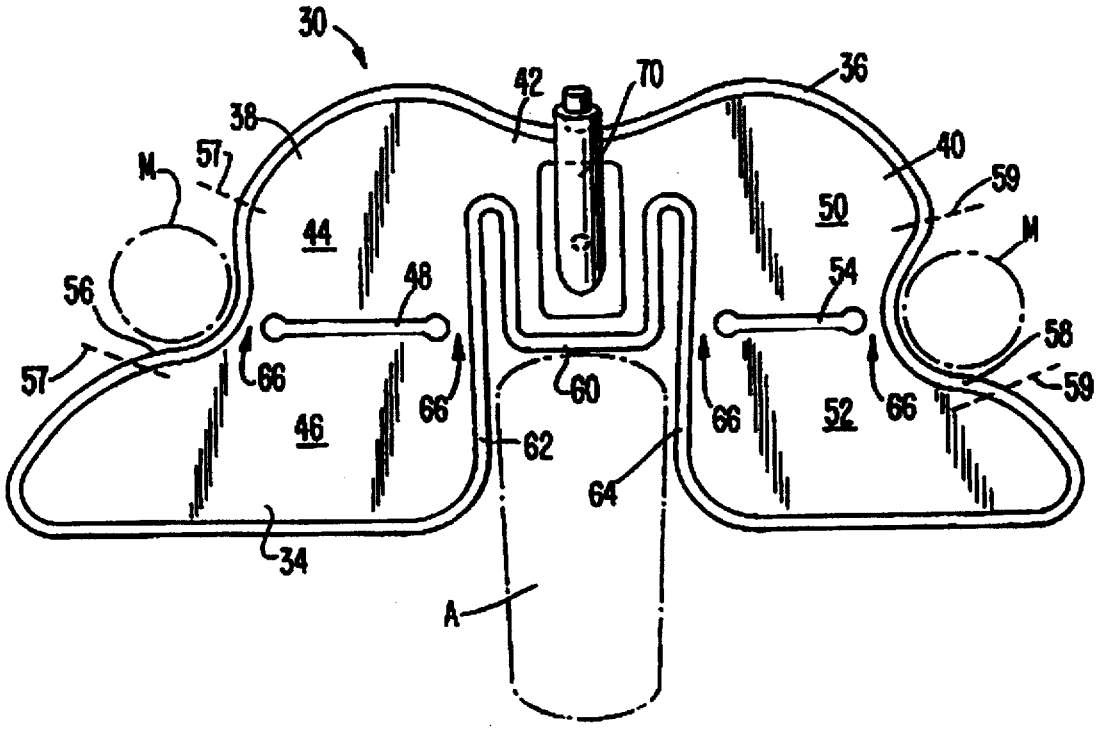
FIG. 4 is a plan view of the inflatable bladder extended flat, with portions of a foot and leg anatomy shown diagrammatically in phantom line.

An inflatable bladder 30 is attached to ankle portion 22 of upper 14. Details of bladder 30 are best seen in FIGS. 3 and 4. Bladder 30 is formed of two separate sheets or layers of elastomeric film, an inside layer 32 and an outside layer 34, which are sealed together along their perimeter edges 36. Bladder 30 has a medial section 38, a lateral section 40, and a small rear section 42 in fluid communication between the medial and lateral sections. Medial section 38 is divided into an upper portion 44 and a lower portion 46 by a divider formed of a weld line 48 connecting inner and outer layers 32 and 34. Lateral section 40 is similarly divided into an upper portion 50 and a lower portion 52 by a divider formed of a weld line 54 connecting inner and outer layers 32 and 34.

When bladder 30 is incorporated into ankle portion 22, weld line 48 is in vertical alignment with the area of the medial malleoli M as shown diagrammatically in FIG. 4, and weld line 54 is vertically aligned with the area of lateral malleoli M, also as illustrated in FIG. 4. Similarly, as illustrated diagrammatically in FIG. 4, perimeter 36 on the medial side defines a cut out area 56, approximately between dash lines 57, which surrounds the area of the medial malleoli so that the bladder does not cover the medial malleoli. On the lateral side, perimeter 36 also defines a lateral cut out area 58, approximately between dash lines 59, which surrounds the area of the lateral malleoli so that bladder 30 does not cover or extend over the lateral malleoli.

A lowermost edge 60 of rear section 42 is located above the achilles tendon area, indicated diagrammatically as A in FIG. 4, and the medial and lateral sections 38, 40 have rearward edges 62 and 64 disposed to the sides of achilles tendon area A so that no portion of inflatable bladder 30, overlies the achilles tendon.

Weld lines 48 and 54 function as dividers in the medial and lateral sections and perform the critical function of preventing the formation of vertical columns of pressurized gas on the medial and lateral sides. Such pressurized vertical columns would unduly restrict the motion of the foot and ankle. To perform this function, medial weld line 48 extends horizontally along substantially the entire extent of medial section 38 in the area of medial malleoli M so that only small areas of fluid communication 66 remain between upper and lower portions 44 and 46. Similarly, weld line 54 extends horizontally along substantially the entire width of lateral section 40 in the area of the lateral malleoli so that only small fluid communication areas 66 exist between upper and lower portions 50 and 52. These small areas 66 are insufficient to allow the formation of rigid vertical columns of pressurized air.

As seen in FIG. 3, bladder 30 is bent in a generally U-shaped configuration for incorporation into ankle portion 22. In order to inflate bladder 30 a hand pump 68 is connected to a valve 70 extending from rear section 42 and ambient air is pumped through valve 70. Inflatable bladder 30 is incorporated into ankle portion 22 between an outer layer 80 of the upper and an inner liner 82 of the upper. A portion of outer layer 80 of the upper, in the area indicated generally by dot-dash line 75, can be formed into a pre-shaped shroud from a relatively high density foam material and may include an aperture 76 through which valve 70 extends and can be accessed by hand pump 68. Since the shroud is formed of a high density foam material, for example 0.2–0.4 gm/cm$^3$, it takes on a relatively fixed, but flexible configuration. When inflated by hand pump 68, medial and lateral sections 38 and 40 expand to fill in the areas surrounding the medial and lateral malleoli to provide a comfortable fit for the high-top portion of the upper. However, since weld lines 48 and 54 prevent the formation of pressurized vertical columns, plantar and dorsi flexion are not restricted.

Figure 5:
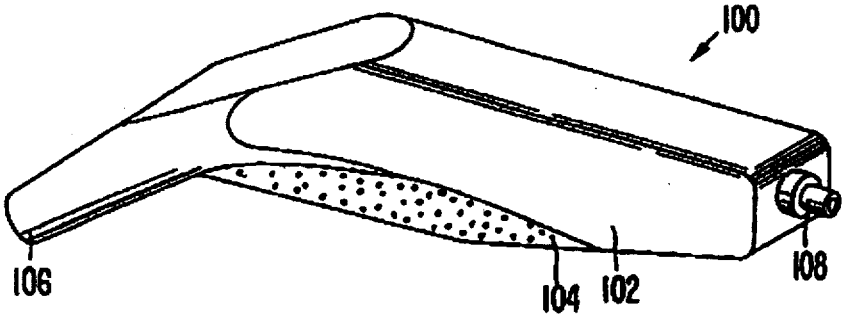
FIG. 5 is a perspective view illustrating in isolation a hand pump of the present invention.

A preferred hand pump 68 of the present invention is illustrated in isolation in FIG. 5 generally at 100. It is seen therein to include a pump body 102 of a flexible plastic material which can be easily grasped and controllably compressed by a hand squeeze and when the pressure of the hand squeeze is released returns to its normal expanded position. The body 102 further includes a bumpy and raised lower surface 104 providing a friction surface to be easily held in the user's hand. When the pump body 102 is compressed, air in the body is expelled or forced out of the outlet end 106. When it is subsequently released, the air is sucked in through the opposite inlet end 108.

Both inlet and outlet ends 108, 106 include internal sliding rods which slide within their nozzle housings between open and closed positions relative to their openings as needed for the pumping action. A sample valve housing for the outlet end 106 and in which the outlet rod slides is shown in isolation in FIGS. 11–13 generally at 110. When released, the outlet plug or rod, which is shown at 111 in FIG. 12, is then sucked or drawn inward to a position spaced from the prongs 112 closing the opening. The prongs or cross-bars 112 provide an abutment surface for depressing the valve assembly shown generally at 114 to open it so that air can be injected into the bladder 116. Similarly, the sliding rod of the inlet end 108 slides to an open position when the pump body 102 is released to allow air to be sucked in through the opening. At that time the outlet end 106 is in a closed position by the outlet rod. When the body 102 is compressed, the sliding inlet rod is forced outwardly to close the inlet end 108 so that all of the expelled air pressure is expelled through the outlet end 106.

Figure 6:
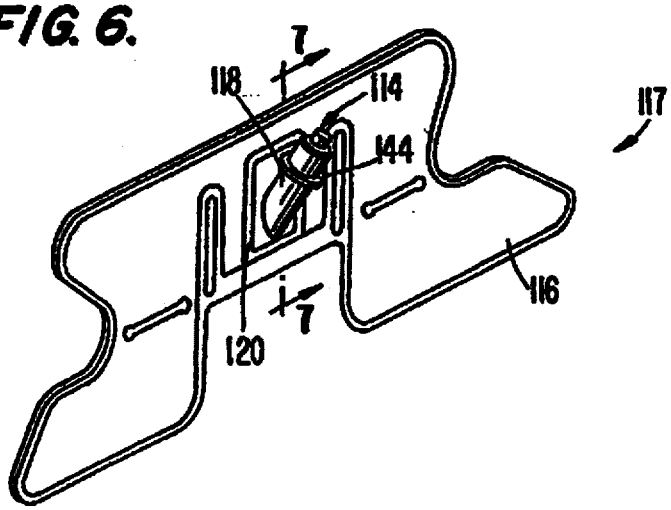
FIG. 6 is a perspective view illustrating in isolation an alternative bladder and valve assembly of the present invention.
Figure 7:
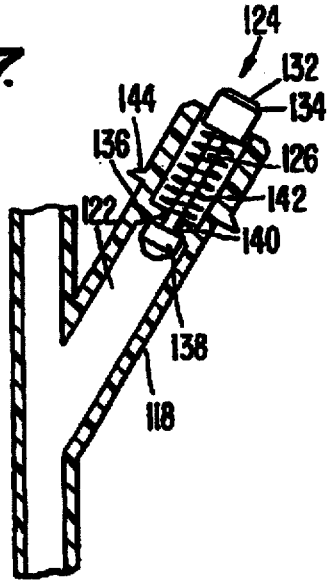
FIG. 7 is a cross-sectional view taken along line 7—7 of FIG. 6.
Figure 8:
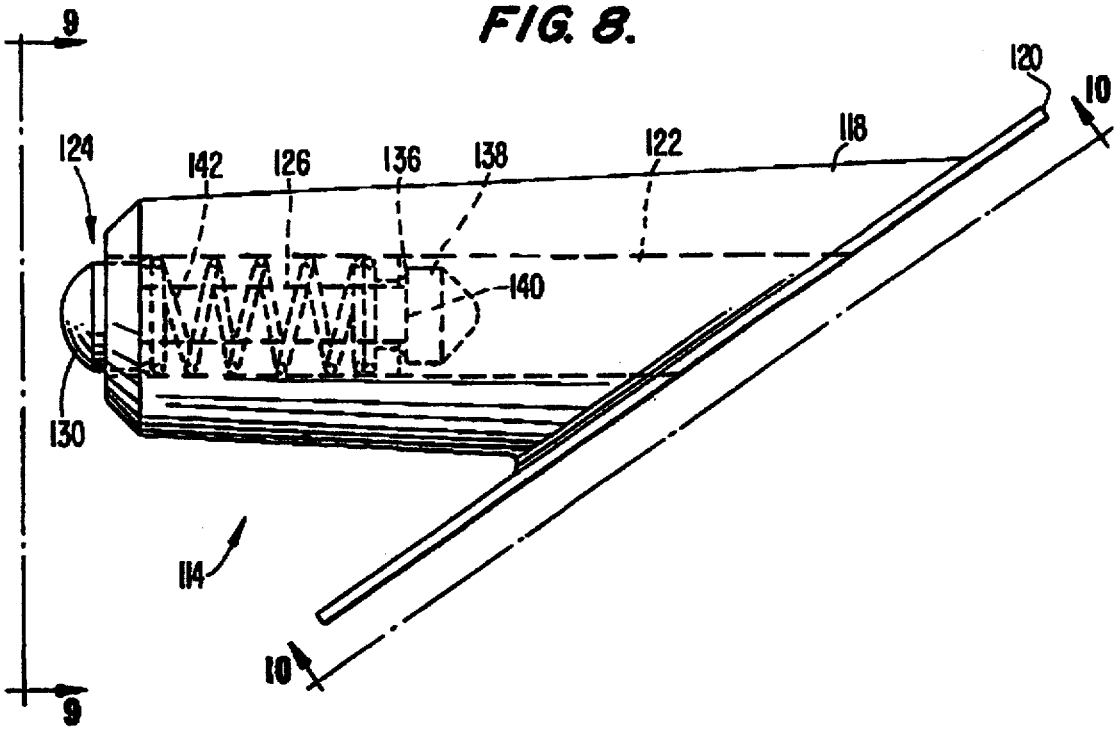
FIG. 8 is a side elevational view of an alternative valve assembly of the present invention which can be used for example on the bladders of FIGS. 3, 4 or 6.
Figure 9:
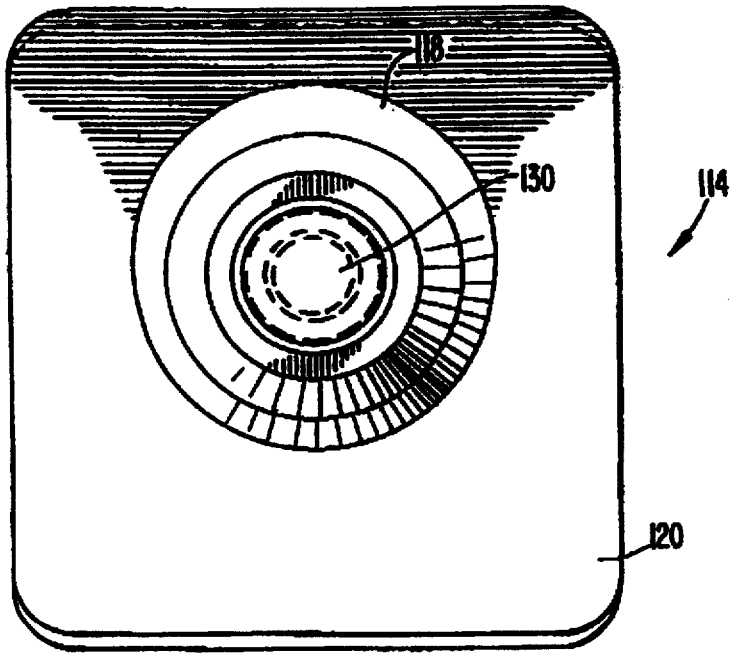
FIG. 9 is a view taken on line 9—9 of FIG. 8.
Figure 10:
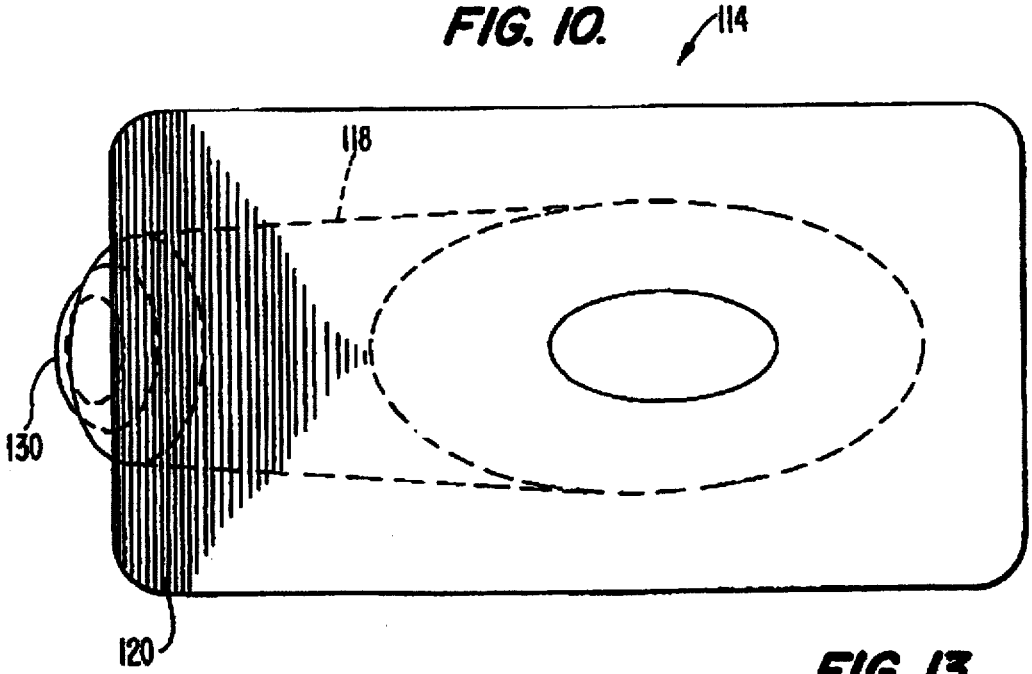
FIG. 10 is a view taken on line 10—10 of FIG. 8.

A bladder and valve assembly of the present invention is shown in FIG. 6 generally at 117. Description of the bladder portion thereof shown generally at 116 is provided with respect to the embodiment illustrated in FIG. 4. The construction and operation of the valve assembly 114 will now be described with reference to FIGS. 6 and 7 as well as a variation thereon as depicted in FIGS. 8–10, and differences between them will also be mentioned. In other words, valve assembly 114 can be substituted for or shows in greater detail valve 70. The valve assembly 114 uses a firm, but compliant, elongated housing 118 of urethane (Shore A80–90) which is compatible with the urethane film bladder 116. This compatibility allows it to be R.F. welded in place along the peripheral flange 120. The housing 118 has an air passageway 122 therethrough and in which is secured a spring-biased valve stem assembly shown generally at 124. This valve stem assembly 124 includes an aluminum valve stem 126 having a broad smooth tip 128 which is easy to manipulate with the user's finger tip. The tip 128 can either be rounded as shown in FIGS. 8 and 9 at 130 or have a flat surface 132 with a beveled edge 134 as best shown in FIG. 7. The valve body or housing 118 has a conical-shaped seat area 136, and thus the molded valve housing advantageously functions as the valve seat. The inner end of the valve stem 126 defines an enlarged body member 138 having a flat surface 140. This flat surface-conical seat area, in contrast to a conical valve body head, allows for more sealing pressure to be applied and a more compliant spring to be used while still obtaining an adequate seal. This is important when the valve assembly is operated by a person's finger as is the present case.

The spring, as shown in FIGS. 6 and 8 at 142, encircles the valve stem 126 and can, for example, be a plated music wire compression spring having an outer diameter of 4.57 millimeters, a wire diameter of 0.36 millimeters, a free length of 12.7 millimeters and a spring rate of 0.49 kilograms per millimeter. When the broad smooth tip 128 of the valve stem 126 is manipulated or pressed down with a finger tip or by other means, the valve stem is pressed inwardly and the plunger end 138 moved inwardly away from the valve seat 136 allowing air to flow therethrough. The valve assembly 114 of FIGS. 6 and 7, unlike that of FIGS. 8–10, has an annular abutment shoulder 144, against which the end of outlet end 106 abuts when hand pump 100 is slipped into place on valve housing 118 for inflating bladder 116 (or bladder 30), as will be explained in greater detail in conjunction with FIGS. 14 and 15.

Thus, unlike standard freon or push-to-deflate valves which are designed to be held together by a crimped metal housing and then attached to a metal can, the valve of the present invention can be connected to the present urethane film bladder. The standard valve is further difficult and uncomfortable to release pressure therefrom by using only one's finger tip.

A standard tire or Schraeder valve, which uses a metal pin and rubber gasket assembly inside of a metal housing, has a valve stem which is somewhat easier to depress than is the push-to-deflate-valve. However, the metal housing of this valve is not readily combinable with the present urethane film, unlike the valve of the present invention.

A needle or Voit type of valve requires a needle to be inserted through a rubber stem for inflation and deflation procedures. This type of valve is difficult, however, to manipulate when a fine adjustment of pressure is desired, such as is required in the present footwear application. It is also difficult to regulate the amount of air released by the needle valve from the inflated object inasmuch as that valve is either fully closed or fully open. The needle valve, however, can be made in the material suitable for bonding or welding to a urethane bladder.

One way or check valves which allow flow in only one direction are commonly found in medical devices such as syringes and bulb pumps. A typical check valve has a hard outer housing of metal and plastic and a softer, rubber-like component which seals the valve when air pressure pushes against it. These valves, however, are not suitable for the present purposes since they cannot release air slowly and accurately and they act in only one direction.

Figure 11:
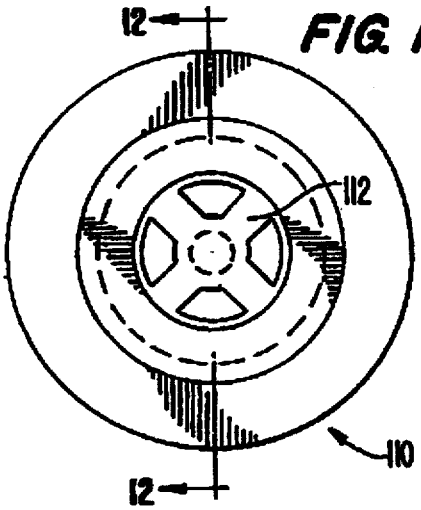
FIG. 11 is an interior end view of a pump nozzle of the hand pump of FIG. 5.
Figure 13:
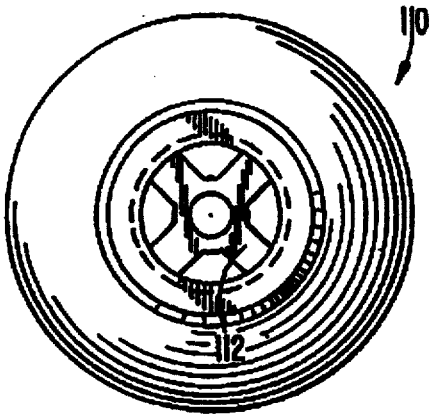
FIG. 13 is an end view of the opposite end of the nozzle of FIG. 5.
Figure 12:
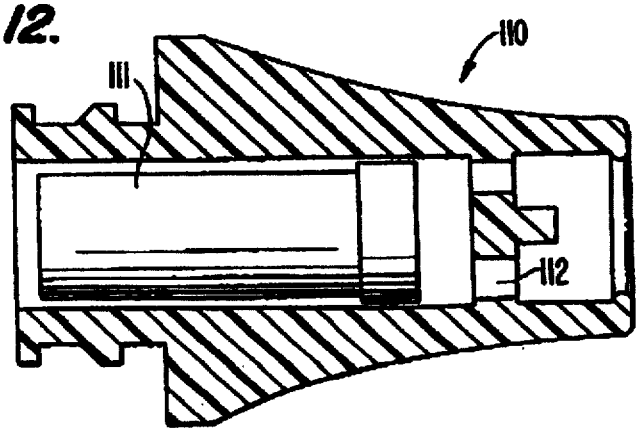
FIG. 12 is a cross-sectional view taken along line 12—12 of FIG. 11.
Figure 14:
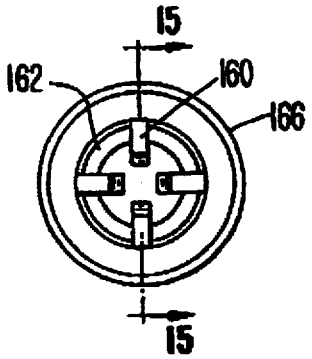
FIG. 14 is an end view of an alternative preferred outlet for the hand pump of FIG. 5.
Figure 15:
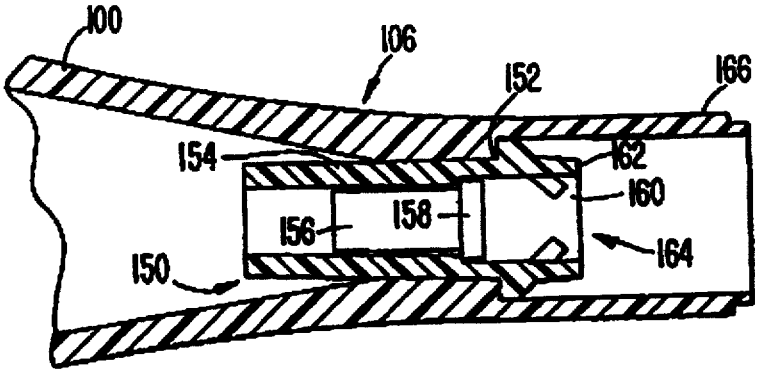
FIG. 15 is a cross-sectional view taken along line 15—15 of FIG. 14 of an alternative preferred outlet end for the hand pump of FIG. 5.

FIGS. 11–13 illustrate one outlet nozzle of the present invention having a connector end (at the left of FIG. 12) adapted to be attached to the body of the hand pump 100. An alternative and preferred outlet nozzle arrangement is illustrated in FIGS. 14 and 15. These two figures show the outlet end 106 of the hand pump 100 with a nozzle 150 built therein against the interior pump shoulder 152. The nozzle 150 defines a cylinder 154 in which plug 154 slides. When in an outward position the head 158 of plug 156 engages the four cross prongs 160. The cross prongs 160 extend radially inward and also angle outward relative to the axis of the cylinder 154, as can be understood from FIGS. 14 and 15. The prongs 160 and the distal end 162 of the cylinder define a seat 164. When the sleeve end 166 of the outlet end 106 is slipped onto and over the elongated housing 118 generally up to the abutment shoulder 144, the seat 164 impacts the tip 128. The valve stem assembly 124 is thereby depressed and the valve assembly 114 opened so that air can be injected by the hand pump 100 into the bladder 116.

Thus, the valve and pump system of the present invention is advantageous over the prior art systems because of the reduced number of parts needed. No connectors, extenders or the like are required, and no connecting hose between the pump and the valve is needed since the one-way valve in the nozzle of the pump actuates the valve. A perfect air-tight seal therebetween is not necessary since the pressures and volumes involved are quite small as can be appreciated. Since the system has few moving parts, it is very reliable. Inflation and deflation of the bladder can be easily and accurately accomplished with the present system.

Numerous characteristics and advantages of the invention have been described in detail in the foregoing description with reference to the accompanying drawings. However, the disclosure is illustrative only and the invention is not limited to the precise illustrated embodiment. Various changes and modifications may be affected therein by persons skilled in the art without departing from the scope or spirit of the invention. For example, the bladder could be used in a three-quarter height shoe wherein the ankle portion of the upper extends only partially over, or only slightly above, the medial and lateral malleoli.

What is claimed is:

1. An athletic shoe for use in activities where plantar and dorsi flexion of the foot occurs about the medial and lateral malleoli of the foot comprising:

a sole;

an upper attached to said sole, said upper allowing substantially unrestricted plantar and dorsi flexion of a foot, and said upper including an ankle portion extending at least partially around the area of the medial and lateral malleoli of the foot;

an inflatable bladder attached within said ankle portion, said inflatable bladder being formed of two layers of elastomeric material joined along the perimeter of the bladder and having a medial section, a lateral section and inlet means for supplying pressurized gas to the interior of said bladder; and prevention means incorporated into both said medial and lateral sections of said bladder for preventing the formation of restrictive vertical columns of pressurized gas in said medial and lateral sections when pressurized gas is supplied to the interior of said bladder, whereby the inflated bladder does not substantially inhibit plantar and dorsi flexion of a foot in the ankle portion of the upper of said athletic shoe, said prevention means including connection points between said two layers of elastomeric material defining small areas of fluid communication between areas of the bladder, with the small defined areas being insufficient in size to allow the formation of restrictive vertical columns.

2. An athletic shoe in accordance with claim 1 wherein said medial section of said bladder is divided into an upper chamber and a lower chamber, said lateral section of said bladder is divided into an upper chamber and a lower chamber, and said prevention means includes a generally horizontally extending divider formed of said connection points in each of said medial and lateral sections dividing said sections into the respective upper and lower chambers.

3. An athletic shoe in accordance with claim 2 wherein said divider in said lateral section is located in vertical alignment with the area of the lateral malleoli and extends along substantially the entire horizontal extent of the lateral section in the area of the lateral malleoli, and said divider in said medial section is located in vertical alignment with the area of the medial malleoli and extends along substantially the entire horizontal extent of the medial section in the area of the medial malleoli.

4. An athletic shoe in accordance with claim 2 or 3 wherein said inflatable bladder is formed of two separate sheets of elastomeric film connected around the perimeter of the bladder, and said dividers are formed as connection lines between the sheets of elastomeric film.

5. An athletic shoe in accordance with claim 1 or 2 wherein said inlet means includes a valve located in a rear section of said bladder, said rear section being located behind and in fluid communication with said medial and lateral sections.

6. An athletic shoe in accordance with claim 5 wherein said rear section has a lowermost edge located above the area of the achilles tendon.

7. An athletic shoe in accordance with claim 1 wherein said lateral section of said bladder has an edge defining a lateral cut out area, said lateral cut out area surrounding the area of the lateral malleoli so that said bladder does not cover the lateral malleoli, and said medial section of said bladder has an edge defining a medial cut out area, said medial cut out area surrounding the area of the medial malleoli so that said bladder does not cover the medial malleoli.

8. An athletic shoe in accordance with claim 1 or 2 wherein said inflatable bladder is secured in said ankle portion of said upper between an outer layer of said upper and inner liner of said upper.

9. An athletic shoe in accordance with claim 8 wherein at least a portion of the outer layer of said upper within which said inflatable bladder is secured is formed as a shroud having a generally fixed shape.

10. An athletic shoe in accordance with claim 9 wherein said shroud is formed of a relatively high density plastic foam material.

11. An athletic shoe in accordance with claim 1 or 2 wherein said ankle portion of said upper extends completely around and above the area of the medial and lateral malleoli.

12. An athletic shoe in accordance with claim 1 further comprising a valve assembly connected to said inflatable bladder and communicable with an opening in said inflatable bladder, said valve assembly including a valve housing, a valve seat disposed in said valve housing, a valve body having an inner portion and an outer portion, and biasing means for biasing said inner portion against said valve seat so that said valve assembly is in a normal closed position, said outer portion being depressible against the bias of said biasing means to move said inner portion away from said valve seat so that said valve assembly is in an open position and air can flow therethrough and through said bladder opening to alter the air pressure in said inflatable bladder.

13. An athletic shoe in accordance with claim 12 wherein said valve housing defines a cylinder having an outer end, and said outer portion, when said valve assembly is in the normal closed position, extends out from said outer end.

14. An athletic shoe in accordance with claim 12 wherein said inner portion has a flat surface, said valve seat has a conical-shaped seat area, and said flat surface mates against said conical-shaped seat area when said valve assembly is in the closed position.

15. An athletic shoe in accordance with claim 12 wherein said valve body comprises a valve stem having an enlarged inner end defining said inner portion and an enlarged outer end defining said outer portion.

16. An athletic shoe in accordance with claim 15 wherein said valve stem is made of aluminum.

17. An athletic shoe in accordance with claim 15 wherein said biasing means comprises a spring encircling said valve stem between said enlarged inner and outer ends.

18. An athletic shoe in accordance with claim 12 further comprising hand pump means connectable to said valve assembly for inflating said inflatable bladder.

19. An athletic shoe in accordance with claim 18 wherein said hand pump means includes one-way valve means for actuating said valve assembly.

20. An athletic shoe in accordance with claim 19 wherein said one-way valve means moves said valve assembly to the open position when said hand pump means is hand squeezed and air is thereby injected through said bladder opening into said inflatable bladder.

21. An athletic shoe in accordance with claim 18 wherein said hand pump means includes a flexible hand-squeezable pump having a pump nozzle and a one-way valve disposed in said pump nozzle.

22. An athletic shoe in accordance with claim 21 wherein said pump nozzle is configured to fit over said outer portion and around said valve housing when in a bladder pumping position.

23. An athletic shoe in accordance with claim 21 wherein said one-way valve defines an air outlet valve, and said hand pump means includes a one-way air inlet nozzle at an end of said hand pump opposite said air outlet valve.

24. An athletic shoe in accordance with claim 12 wherein said valve housing is welded along a flange to said inflatable bladder.

25. An athletic shoe in accordance with claim 24 wherein said inflatable bladder is constructed of a urethane and said valve housing is constructed of a urethane which is compatible with said urethane of said inflatable bladder.

26. An athletic shoe in accordance with claim 12 wherein said valve body and said biasing means together form a spring-tensioned valve stem held in said valve housing such that said outer portion extends a distance out from said valve housing when said valve assembly is in a closed position.

27. An athletic shoe in accordance with claim 12 wherein said valve assembly allows air to be released controllably and accurately by finger tip depression of said outer portion.

28. An athletic shoe in accordance with claim 1 wherein said inflatable bladder is formed by blow molding.

29. An athletic shoe in accordance with claim 1 wherein said inflatable bladder is constructed of polyurethane.

30. An athletic shoe in accordance with claim 1 wherein said inflatable bladder is formed of two sheets of elastomeric film connected around the perimeter of the bladder, and said connection points being formed between the two sheets of elastomeric film in the area adjacent the medial and lateral malleoli, said bladder including an upper chamber above said connection points and a lower chamber below said connection points, said connection points defining small areas of fluid communication between said upper and lower chambers that are insufficient in size to allow the formation of restrictive vertical columns of pressurized air.

31. An athletic shoe for use in activities where plantar and dorsi flexion of the foot occurs about the medial and lateral malleoli of the foot comprising:

a sole;

an upper attached to said sole, said upper allowing substantially unrestricted plantar and dorsi flexion of a foot within said athletic shoe, and said upper including an ankle portion extending at least partially around the area of the medial and lateral malleoli of the foot;

an inflatable bladder attached within said ankle portion, said inflatable bladder having a medial section divided into an upper chamber and a lower chamber, a lateral section divided into an upper chamber and a lower chamber and inlet means for supplying pressurized gas to the interior of the bladder, said lateral section having an edge defining a lateral cut-out area surrounding the area of the lateral malleoli so that said bladder does not cover the lateral malleoli, said medial section of said bladder having an edge defining a medial cut-out area surrounding the area of the medial malleoli so that said bladder does not cover the medial malleoli, and a divider extending generally horizontally in each of said medial and lateral sections for dividing said sections into the respective upper and lower chambers, said dividers defining small areas of fluid communication between said upper and lower chambers that are insufficient in size to allow the formation of restrictive vertical columns of pressurized gas in the medial and lateral sections, whereby the inflated bladder does not substantially inhibit plantar and dorsi flexion of a foot in the ankle portion of the upper of said athletic shoe.

32. An athletic shoe in accordance with claim 31 wherein said divider in said lateral section is located in vertical alignment with the area of the lateral malleoli and extends along substantially the entire horizontal extent of the lateral section in the area of the lateral malleoli, and said divider in said medial section is located in vertical alignment with the area of the medial malleoli and extends along substantially the entire horizontal extent of the medial section in the area of the medial malleoli.

33. An athletic shoe in accordance with claim 31 or 32 wherein said inflatable bladder is formed of two separate sheets of elastomeric film connected around the perimeter of said bladder, and said dividers are formed as connection lines between said sheets of elastomeric film.

34. An athletic shoe in accordance with claim 33 wherein said inlet means includes a valve located in a rear section of said bladder, said rear section being located behind and in fluid communication with said medial and lateral sections.

35. An athletic shoe in accordance with claim 34 wherein said rear section has a lowermost edge located above the area of the achilles tendon.

36. An athletic shoe in accordance with claim 33 wherein said inflatable bladder is secured in said ankle portion of said upper between an outer layer of said upper and an inner liner of said upper.

37. An athletic shoe in accordance with claim 36 wherein at least a portion of the outer layer of said upper within which said inflatable bladder is secured is formed as a shroud having a generally fixed shape.

38. An athletic shoe in accordance with claim 37 wherein said shroud is formed of a relatively high density plastic foam material.

39. An athletic shoe in accordance with claim 33 wherein said ankle portion extends completely around and above the area of the medial and lateral malleoli.

40. An athletic shoe in accordance with claim 31 or 32 wherein said inlet means includes a valve located in a rear section of said bladder, said rear section being located behind and in fluid communication with said medial and lateral sections.

41. An athletic shoe in accordance with claim 34 wherein said rear section has a lowermost edge located above the area of the achilles tendon.

42. An athletic shoe in accordance with claim 31 or 32 wherein said inflatable bladder is secured in said ankle portion of said upper between an outer layer of the upper and inner liner of the upper.

43. An athletic shoe in accordance with claim 42 wherein at least a portion of the outer layer of said upper within which said inflatable bladder is secured is formed as a shroud having a generally fixed shape.

44. An athletic shoe in accordance with claim 43 wherein said shroud is formed of a relatively high density plastic foam material.

45. An athletic shoe in accordance with claim 31 or 32 wherein said ankle portion of said upper extends completely around and above the area of the medial and lateral malleoli.

46. An athletic shoe for use in activities where plantar and dorsi flexion of the foot occurs about the medial and lateral malleoli of the foot, the medial and lateral malleoli including posterior and inferior portions, comprising:

a flexible upper having a collar area that allows substantially unrestricted plantar and dorsi flexion of a foot;

a flexible sole connected to said upper;

a valve assembly associated with said flexible upper; and a bladder system positioned in said collar area, said bladder system comprising a plurality of communicating fluid chambers which are adjustably inflatable with pressurized fluid, via said valve assembly, to provide a customized fit for a foot within said athletic shoe by conforming to and filling in the posterior and inferior portions of the malleoli of the foot, said fluid chambers being formed of two layers of elastomeric material joined along the perimeter of the fluid chambers, connection points between said two layers of elastomeric material defining small areas of fluid communication between areas of the chambers, said defined small areas being insufficient in size to allow the formation of restrictive columns of pressurized fluid adjacent the malleoli that would substantially restrict plantar and dorsi flexion of the foot within said athletic shoe when said chambers are pressurized with fluid.

47. The shoe of claim 46 wherein said connection points are formed as a plurality of weld lines defining at least in part said fluid chambers.

48. The shoe of claim 47 wherein said weld lines comprise first and second generally horizontal weld lines, said first weld line being vertically aligned with the area of the lateral malleoli of the foot and said second weld line being vertically aligned with the area of the medial malleoli of the foot.

49. The shoe of claim 46 wherein said bladder system includes a medial section in the area of the medial malleoli of the foot, a lateral section in the area of the lateral malleoli of the foot, a first pressure fluid divider extending generally horizontally along substantially the entire extent of said medial section so that only at least one small fluid communication area exists between chambers of said bladder system above and below said first divider, and a second pressure fluid divider extending generally horizontally along substantially the entire extent of said lateral section so that only at least one small fluid communication area exists between chambers of said bladder system above and below said second divider, and wherein all said small areas are insufficient to allow the formation therein of rigid generally vertical columns of pressurized fluid.

* * * * *